United States Patent [19]

Foster

[11] Patent Number: 4,493,260

[45] Date of Patent: Jan. 15, 1985

[54] ANNULAR SHAPED CHARGE FOR BREACHING MASONARY WALLS

[75] Inventor: John S. Foster, Richmond, Va.

[73] Assignee: The United States of America as represented by the Secretary of the Navy, Washington, D.C.

[21] Appl. No.: 549,841

[22] Filed: Nov. 8, 1983

[51] Int. Cl.[3] ..... F42B 1/02

[52] U.S. Cl. ..... 102/307; 102/308; 102/476

[58] Field of Search ..... 102/306, 307, 308, 309, 102/310, 476

[56] References Cited

U.S. PATENT DOCUMENTS

| | | | |
|---|---|---|---|
| 2,839,997 | 6/1958 | Church et al. | 102/307 |
| 3,191,533 | 6/1965 | Hopson | 102/306 |
| 3,244,102 | 4/1966 | Wofford et al. | 102/307 |
| 3,404,600 | 10/1968 | Bilek | 102/306 X |
| 3,837,279 | 9/1974 | Cooke, Jr. | 102/24 R |
| 4,063,509 | 12/1977 | Leonard et al. | 102/310 |
| 4,184,430 | 1/1980 | Mock | 102/307 |
| 4,348,955 | 9/1983 | Rowley et al. | 102/317 |
| 4,418,622 | 12/1983 | Foster et al. | 102/307 |

FOREIGN PATENT DOCUMENTS

| | | | |
|---|---|---|---|
| 113685 | 8/1941 | Australia | 102/476 |
| 1728461 | 1/1973 | Fed. Rep. of Germany | 102/476 |
| 2533585 | 2/1977 | Fed. Rep. of Germany | 102/476 |
| 2287027 | 6/1976 | France | 102/476 |
| 205750 | 2/1968 | U.S.S.R. | 102/306 |

*Primary Examiner*—Peter A. Nelson

*Attorney, Agent, or Firm*—Robert F. Beers; Kenneth E. Walden; Frederick A. Wein

[57] ABSTRACT

A shaped charge and method of breaching reinforced masonary walls is disclosed. The shaped charge includes an annular liner located centrally between the ends of a cylindrical container filled with explosive. The device is placed in a pilot hole in the wall and is detonated simultaneously at the ends. The charge creates an annular radially expanding jet of explosive gases and fragments directed into the wall providing a man size opening therein.

4 Claims, 4 Drawing Figures

ANNULAR SHAPED CHARGE FOR BREACHING MASONARY WALLS

BACKGROUND OF THE INVENTION

This invention relates to shaped charges, and more particularly to a shaped charge and method for breaching reinforced masonary construction.

In the demolition of masonary structures, and in particular the breaching of reinforced concrete walls, sufficient for persons to pass through, large quantities of bulk explosives have been required. For example, to breach a two foot thick reinforced concrete wall, so that a person could pass through the hole created, a minimum of 28 pounds of bulk explosive placed next to the wall is required. Such large quantities of explosive in bulk form are dangerous and time consuming to handle. Special precautions must be taken to protect personnel and special containers and material handling equipment is required to transport such explosives.

Also bulk explosive must be placed next to the wall at the location where it is to be breached, which makes it difficult, if not impossible, to penetrate the wall at locations off the ground. When bulk explosives are detonated next to a wall, a substantial portion of the explosive force is directed away from the wall and is not utilized to penetrate the structure. This is dangerous to surrounding structures and personnel and is a highly inefficient use of the explosive.

It can be appreciated that bulk explosives are inefficient means for breaching concrete structures and there is a need for a small, lightweight, relatively safe and powerful device for breaching such structures. Ideally the device would be capable of providing man size openings in the structure.

SUMMARY OF THE INVENTION

Accordingly, it is an object of the invention to provide for an explosive device capable of breaching reinforced masonary construction.

Another object of the invention is to provide for an explosive device for breaching reinforced concrete walls that expends substantially all of its explosive energy in breaching the wall.

A further object of the invention is to provide for an explosive device for breaching reinforced concrete walls that does not require the use of bulk explosives.

Another object of the invention is to provide for an explosive device that is capable of making man size openings in reinforced concrete walls.

A still further object of the invention is to provide for an explosive device for breaching concrete structures that is easily handled by personnel.

And, another object of the invention is to provide for an explosive device for breaching concrete walls that reduces the risk of injury to personnel and surrounding structures.

The objects of the invention are achieved and the shortcomings of the prior art are overcome by utilizing the principles of shaped charges by providing for a shaped charge device having a hemispherical annular shaped liner centrally located between the ends of the device. The device is filled with an explosive. The device is positioned within a pilot hole in the wall to be breached and the opposing ends are simultaneously detonated causing the annular liner to collapse creating an annular jet directed Radially outward into the wall.

DETAILED DESCRIPTION OF THE PREFERRED EMBODIMENT

Figure 2:
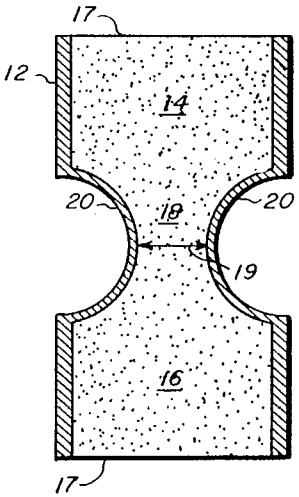
FIG. 2 is a vertical longitudinal cross-sectional view of the preferred embodiment showing details of construction.
Figure 1:
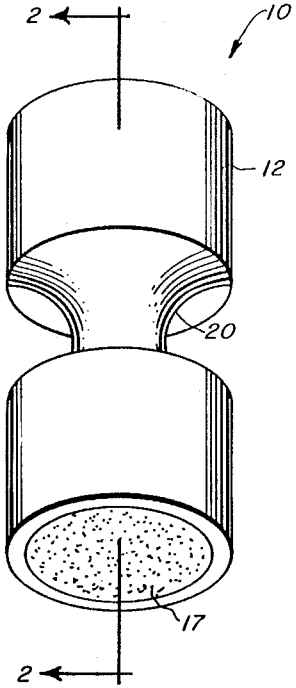
FIG. 1 is a pictorial representation of the preferred embodiment of the invention.

Shown in FIG. 1 is an hourglass shaped charged 10. The shaped charge includes an outer case 12 having a first cavity portion 14 on one end and a second cavity portion 16 on an opposing second end. Cavities 14, 16 are interconnected by a third cavity portion 18 located coaxial therebetween. Third cavity 18 has a reduced radial dimension 19 centrally located therealong, see FIG. 2, and a shape defined by an annular concave section of case 12 located equidistance from each end. The concave section defines a shaped charge liner 20. Liner 20 has a reduced cross-sectional thickness from the portions of case 12 that surround cavities 14, 16. Liner 20 is designed to collapse, invert, and form an expanding annular jet 22, see FIG. 4, when the device is detonated. Case 12 and liner 20 are preferrably machined from a single piece of material capable of forming reactive jets, such as aluminum or zirconium; however, other acceptable liner and case materials include castable zinc aluminum alloys. Changing the liner shape and material changes the effect of the charge. For example, the hemispherical liner gives large mass-fraction in the jet, and an aluminum liner gives an increased energetic jet. Other acceptable shapes include V and parabolic shapes. Those skilled in shaped charges can readily adapt other shapes and materials having the benefit of the disclosure herein, e.g., truncated conical shaped cavities 14, 16, or a combination of cylindrical and conical.

Cavities 14, 16, 18 are filled with any well known explosive 17 used in shaped charges, e.g., those generally known as Composition B, HMX, Octol, RDX, or other cast loaded or press loaded explosives.

In use, the device is initiated simultaneously at the opposite ends by initiation means, not shown, and included preferrably on the surfaces of the charge on each end.

Figure 4:
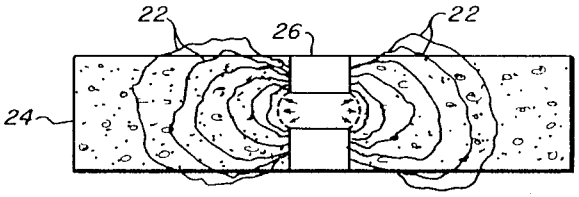
FIG. 4 is a horizontal longitudinal cross-sectional view of the wall of FIG. 3 showing graphically the preferred embodiment in use.
Figure 3:
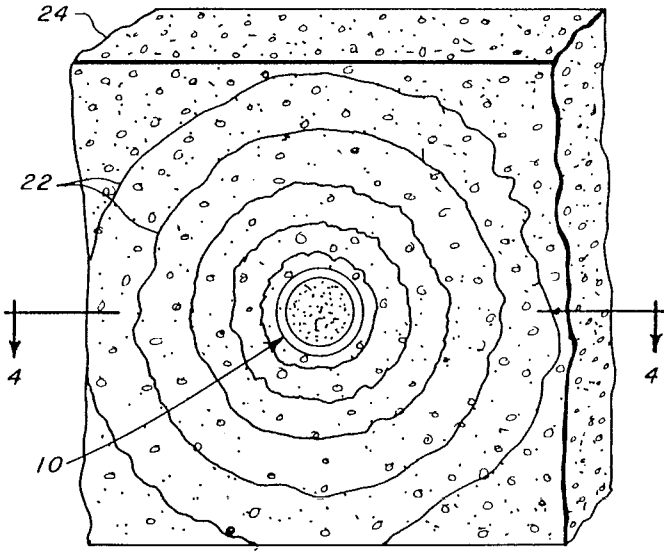
FIG. 3 is a front pictorial view showing graphically the preferred embodiment in use breaching a wall.

Shown in FIGS. 3 and 4 is a portion of a reinforced masonary wall 24 that is to be breached. In use, a pilot hole 26, is slightly larger than the diameter of charge 10 for providing enough clearance for jet formation. Pilot hole 26 is made in the wall at the location to be breached. The pilot hole is made by conventional means, such as an impacting shape charge or projectile. To breach an 8" thick double reinforced concrete wall providing a man sized hole, on the order of 2 square feet, the shaped charge of this invention only need be 8 inches in length, 3.5 inches in diameter at cavities 14, 16, provided with a hemispherical liner having a 2 inch diameter, and filled with approximately $2\frac{3}{4}$ pounds of one of the above mentioned explosives. A $3\frac{1}{2}$ inch pilot hole is within the capabilities of present devices.

Charge 10 is placed within the pilot hole and the charge in cavity portions 14, 16, are simultaneously detonated with the detonation waves travelling toward reduced section 19 into cavity portion 18 thus causing liner 20 to collapse, invert, and form an annular, radially expanding jet of liner material and further causing explosive gases 22 directed into the wall interior, as shown in FIG. 4, to breach the wall.

Having described the preferred embodiment and its operation, those skilled in the field will readily be able to devise other embodiments and modifications having the benefit of said description in conjunction with the accompanying drawings Therefore said embodiments and modifications are to be considered within the scope of the appended claims.

What is claimed is:

1. A device for breaching masonary walls comprising:

a symmetrical container for insertion into a pilot hole in the wall having a first cylindrical cavity portion disposed at one end, a second cylindrical cavity portion disposed at a second end, and a third cavity portion disposed midway between said first and second cavity portions the shape of the third cavity portion being defined by an annular concave portion of said container extending into said third cavity portion and defining a shaped charge liner adapted to collapse, invert, fragment, and create a jet of annular radially expandable fragments and explosive gases;

an explosive filling said cavity portions presenting two exposed surfaces at the first and second cavity portions for generating the explosive gases and a force for collapsing, inverting, and fragmenting the concave shaped charge liner; and, simultaneous detonation means associated with the explosive surfaces for simultaneous initiating detonation of said explosive in the first and second cavity portions.

2. The device as defined in claim 1 wherein the concave shaped charge liner portion is an annular hemispherial shape section of the container located midway between the first and second cavity portions.

3. A device for breaching masonary walls comprising: a hollow case for placement in a pilot hole in an external structure, an explosive disposed within said case for generating explosive gases, said explosive including two opposed portions and means associated with said opposed portions for simultaneously initiating detonation of said explosive of said portions, and means associated with said case for generating an annular radially expanding jet of explosive gases and case fragments directed into the external structure, said means comprising an annular concave portion disposed midway along the length of the case and extending radially inward of the case, the concave portion defining an annular shaped charge liner adapted to collapse, invert. fragment and form the annular radially expending jet.

4. The device as defined in claim 3 wherein the concave portion is hemispherical in shape.

* * * * *